US007845340B2

(12) United States Patent
Fuchinoue et al.

(10) Patent No.: US 7,845,340 B2
(45) Date of Patent: Dec. 7, 2010

(54) AIR-EXHAUST MIXING APPARATUS

(75) Inventors: Ryo Fuchinoue, Greensburg, IN (US); Catherine W. Dippold, Columbus, IN (US)

(73) Assignee: Cummins Inc., Columbus, IN (US)

( * ) Notice: Subject to any disclaimer, the term of this patent is extended or adjusted under 35 U.S.C. 154(b) by 210 days.

(21) Appl. No.: 12/002,403

(22) Filed: Dec. 17, 2007

(65) Prior Publication Data

US 2008/0149198 A1 Jun. 26, 2008

Related U.S. Application Data

(60) Provisional application No. 60/876,637, filed on Dec. 22, 2006.

(51) Int. Cl.
*F02B 47/08* (2006.01)
*F02M 25/07* (2006.01)

(52) U.S. Cl. ..... 123/568.17; 123/568.11; 60/605.2

(58) Field of Classification Search ..... 123/568.11, 123/568.17, 585, 590, 306; 60/605.1, 605.2; 336/163.1, 163.2, 165.1, 165.2; 137/561 A
See application file for complete search history.

(56) References Cited

U.S. PATENT DOCUMENTS

| | | | | |
|---|---|---|---|---|
| 2,354,179 | A | 7/1944 | Blanc | |
| 3,662,722 | A | 5/1972 | Sarto | |
| 5,611,204 | A | 3/1997 | Radovanovic et al. | |
| 5,908,475 | A | 6/1999 | Morris, Jr. et al. | |
| 5,937,650 | A * | 8/1999 | Arnold | 60/605.2 |
| 6,267,106 | B1 * | 7/2001 | Feucht | 123/568.17 |
| 6,343,594 | B1 | 2/2002 | Koeslin et al. | |
| 6,425,382 | B1 | 7/2002 | Marthaler et al. | |
| 6,427,671 | B1 | 8/2002 | Holze et al. | |
| 6,609,374 | B2 * | 8/2003 | Feucht et al. | 60/602 |
| 6,732,524 | B2 | 5/2004 | Sponton | |
| 6,748,741 | B2 * | 6/2004 | Martin et al. | 60/605.2 |
| 6,886,544 | B1 | 5/2005 | Bui | |
| 6,899,089 | B2 | 5/2005 | Shiraishi et al. | |
| 6,935,321 | B1 | 8/2005 | Sullivan et al. | |
| 7,032,578 | B2 | 4/2006 | Liu et al. | |
| 2001/0027784 | A1 | 10/2001 | Schmid et al. | |
| 2003/0111065 | A1 | 6/2003 | Blum | |
| 2003/0116145 | A1 | 6/2003 | Coleman et al. | |
| 2003/0178013 | A1 | 9/2003 | Schmid et al. | |
| 2004/0079347 | A1 | 4/2004 | Bender et al. | |
| 2004/0099257 | A1 | 5/2004 | Berggren et al. | |
| 2004/0112345 | A1 | 6/2004 | Bertilsson et al. | |
| 2004/0144372 | A1 | 7/2004 | Ricart-Ugaz et al. | |
| 2005/0072408 | A1 | 4/2005 | Yu | |

FOREIGN PATENT DOCUMENTS

| | | | |
|---|---|---|---|
| DE | 44 20 247 | A1 | 3/2006 |
| EP | 0 857 870 | A2 | 8/1998 |
| JP | 2001-173518 | A | 6/2001 |

* cited by examiner

*Primary Examiner*—Stephen K Cronin
*Assistant Examiner*—Raza Najmuddin
(74) *Attorney, Agent, or Firm*—Krieg DeVault LLP; J. Bruce Schelkopf, Esq.

(57) ABSTRACT

One embodiment is an apparatus including an air-exhaust mixing passageway, a first lip extending into the passageway, a second lip extending into the passageway, a valley intermediate the first lip and the second lip, and an exhaust inlet aperture in flow communication with the flow channel.

18 Claims, 3 Drawing Sheets

AIR-EXHAUST MIXING APPARATUS

RELATED APPLICATIONS

The present application claims the benefit of U.S. Provisional Patent Application No. 60/876,637 filed Dec. 22, 2006, which is incorporated herein by reference.

TECHNICAL FIELD

The technical field generally relates to air-exhaust mixing apparatuses.

BACKGROUND

Exhaust gas recirculation (EGR) is used to reduce pollution generated by engines and other combustion devices. With EGR, a portion of the exhaust generated by a combustion reaction is mixed with intake air in order to reduce the amount of pollutants expelled into the atmosphere. Inadequate mixing of the air and exhaust can lead to the creation of increased concentrations of pollutants in the exhaust gas. Various attempts to provide adequate mixing of air and exhaust suffer from a number of drawbacks, disadvantages and shortcomings. There remains a longstanding need for air-exhaust mixing apparatuses which address these issues.

SUMMARY

One embodiment is an apparatus including an air-exhaust mixing passageway, a first lip extending into the passageway, a second lip extending into the passageway, a valley intermediate the first lip and the second lip, and an exhaust inlet aperture in flow communication with the valley. Further embodiments, forms, objects, features, advantages, aspects, embodiments and benefits shall become apparent from the following descriptions, drawings, and claims.

DETAILED DESCRIPTION

Figure 1:
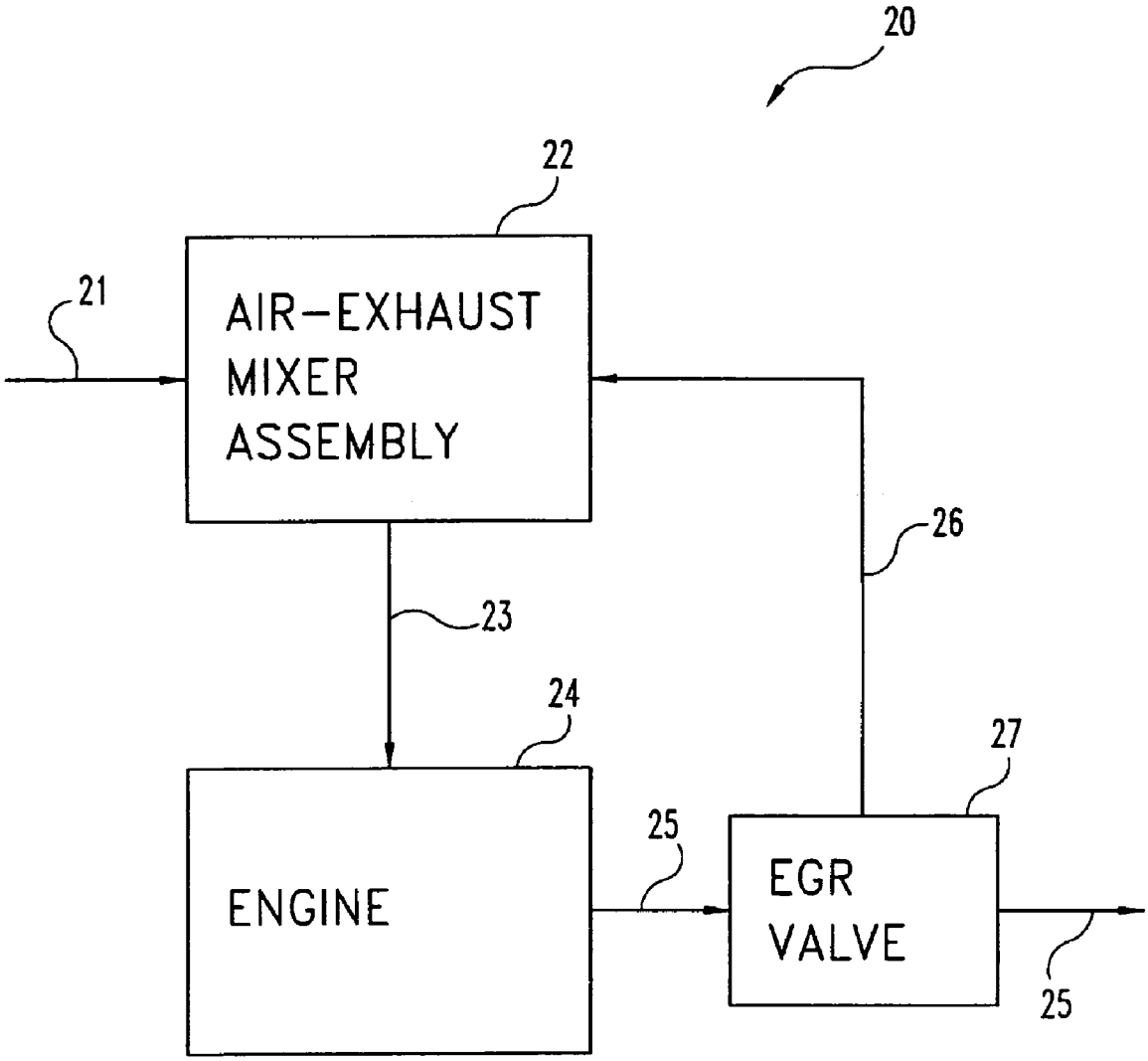
FIG. 1 is a block diagram of one embodiment of an EGR system.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention illustrated therein being contemplated as would normally occur to one skilled in the art to which the invention relates.

With reference to FIG. 1, an EGR system 20 is illustrated in schematic form. System 20 includes an air intake 21, an air-exhaust mixer 22, engine intake manifold 23, engine 24, exhaust conduit 25, EGR flow coupling 26, and EGR valve 27. Air intake 21 and EGR conduit 26 are flow coupled to air-exhaust mixer 22. Air-exhaust mixer 22 is flow coupled to engine 24 through engine intake manifold 23. Engine 24 is flow coupled to EGR valve 27 through exhaust conduit 25, and EGR valve 27 is flow coupled to air-exhaust mixer 22 through EGR flow coupling 26. In one embodiment, EGR flow coupling 26 involves the attachment of an EGR valve output to an air-exhaust mixing apparatus. In other embodiments, EGR flow coupling 26 may include one or more intermediate flow passages, conduits or other structures.

In system 20, air is supplied through air intake 21. The supplied air can be filtered, unfiltered, and/or conditioned in other manners. In one embodiment, ambient air is pressurized and sent through an air cooler (not illustrated) before being sent to the air intake 21. Pressurization can be accomplished, for example, by a turbocharger or supercharger. EGR valve 27 selectably recirculates a portion of exhaust from the engine 24 to air-exhaust mixer 22. Exhaust which is not recirculated by EGR valve 27 continues through exhaust conduit 25. In addition, exhaust in system 20 may be utilized to drive a turbocharger and may also be treated by exhaust aftertreatment systems to reduce the emission of pollutants. Air-exhaust mixer assembly 22 mixes exhaust received from EGR valve 27 with air from air intake 21. The mixture is then supplied to engine 24 through engine intake manifold 23. In a preferred embodiment, engine 24 is a turbocharged diesel engine. It should be understood that a variety of other types of engines and combustion devices are contemplated by additional embodiments including non-turbocharged diesel engines as well as engines which combust fuels other than diesel.

Figure 2:
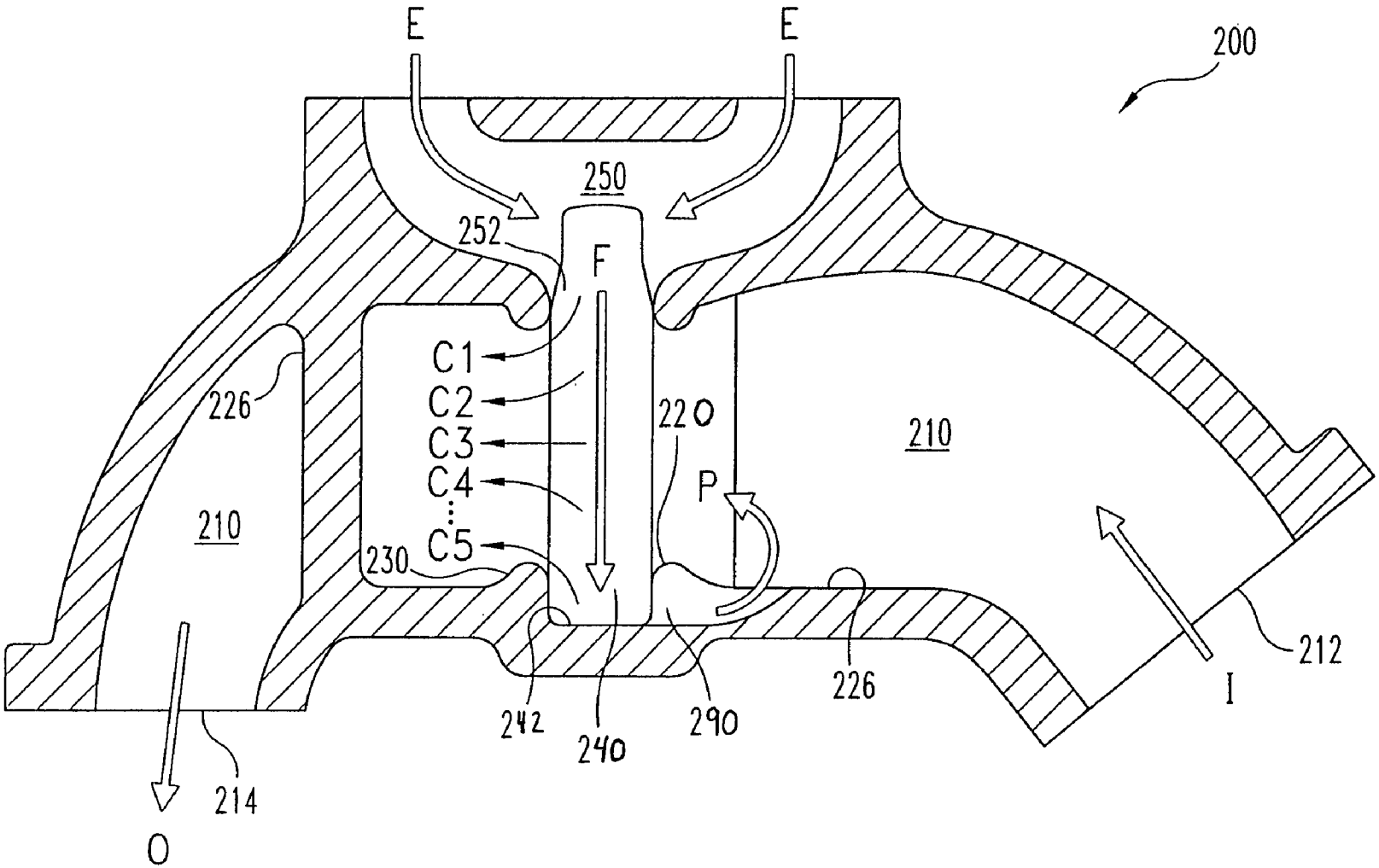
FIG. 2 is a side sectional view of one embodiment of an air-exhaust mixer.
Figure 3:
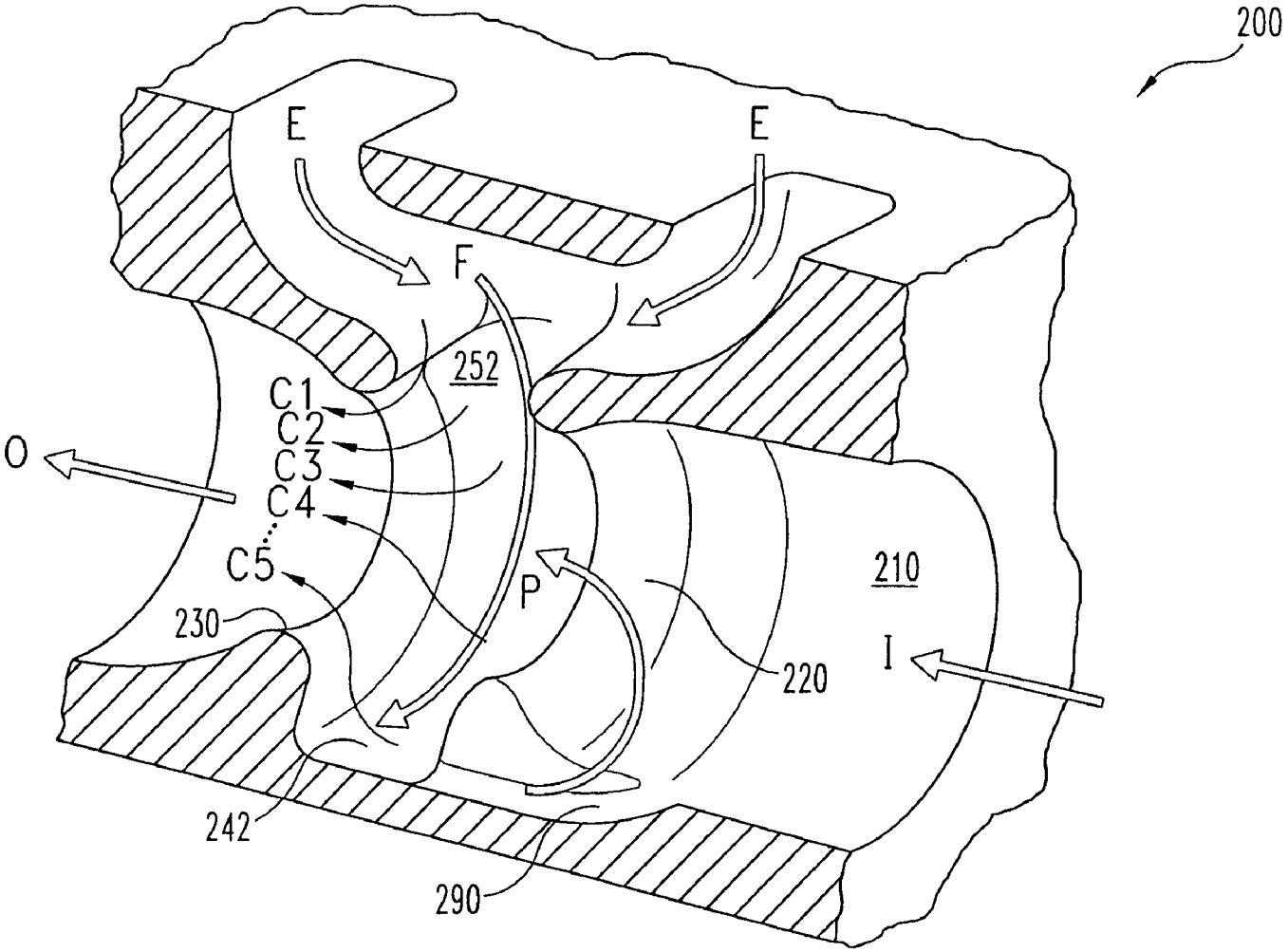
FIG. 3 is a perspective sectional view of the air-exhaust mixer of FIG. 2.

With reference to FIGS. 2 and 3 there is illustrated one embodiment of an air-exhaust mixer 200. Mixer 200 includes a flow passageway 210 which receives an air flow at intake 212 as indicated by arrow I. As air flow proceeds through flow passageway 210 it encounters lips 220 and 230 which extend into flow passageway 210 to provide a constriction which increases the speed and decreases the pressure of airflow. Valley 240 is positioned intermediate lips 220 and 230 and is substantially open to the region of flow passageway 210 intermediate lips 220 and 230.

As illustrated in FIG. 2, valley 240 has a generally annular shape with a substantially constant width and depth, and the depth of the bottom surface 242 of valley 240 is greater than that of surface 226 of flow passage 210. Other embodiments include flow channels which taper from a maximum width near aperture 252 to a minimum width, taper from a maximum depth near aperture 252 to a minimum depth, or both. Further embodiments contemplate flow channels with greater or lesser depths than the illustrated embodiment. Additional embodiments contemplate flow channels which extend over only a portion of the interior of flow passage 210. Lips 220 and 230 could also extend over only a portion of the interior of flow passage 210 or could have varying heights or widths, though in the illustrated embodiment they have substantially constant dimensions. In a preferred embodiment, lips 220 and 230 and valley 240 are integral portions of a casting. In a most preferred embodiment, substantially the entire body of mixer 200 is a single piece casting. Other embodiments contemplate discrete components which are coupled together to provide lips and an intermediate valley.

Mixer 200 includes exhaust intake passage 250 which receives exhaust flow from an exhaust source, such as an EGR valve, as indicated by arrows E. The received exhaust flows through exhaust intake passage 250 to exhaust intake aperture 252 and then to valley 240. Exhaust flows through valley 240 as illustrated by arrow F. As indicated with arrows C1, C2, C3, C4, and C5 exhaust flow exits valley 240 and mixes with the air flow in flow passageway 210. As indicated by the ellipsis, arrows C1, C2, C3, C4, and C5 are not exclusive routes, rather the mixing flow of exhaust from channel 240 can be essentially continuous along channel 240. When a lower amount of exhaust is provided to valley 240, exhaust flow valley 240 could be completed before exhaust reaches the farthest extent of valley 240.

A preferred embodiment of mixer 200 includes condensation slot 290. Moisture and/or particulate which collects in valley 240 can drain via slot 290 to avoid accumulation in valley 240 as well as potential attendant effects such as corrosion. As indicated by arrow P, matter collected in slot 290 is also mixed into the air flow I through passageway 210. In other embodiments, condensation slot 290 is not present and lip 220 continues through the region in which it is defined.

The air-exhaust mixture continues to flow through passageway 210. In a preferred embodiment the mixture flows past central member 226 which is positioned in flow passageway 210. In other embodiments, central member 226 is not present. The exhaust-air mixture then flows to outlet 214 where it is outlet from mixer 200 as indicated by arrow O. As mentioned above, outlet 214 can be flow coupled to an air intake of an internal combustion engine, or to an air intake manifold.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

an air-exhaust mixing passageway;

a first lip extending into the passageway;

a second lip extending into the passageway;

a valley intermediate the first lip and the second lip; and an exhaust inlet aperture in flow communication with the valley;

wherein the valley extends intermediate the first lip and the second lip and is substantially open to the air-exhaust mixing passageway and substantially free of overhang by the first lip and the second lip.

2. The apparatus of claim 1 further comprising an EGR valve in flow communication with the exhaust inlet aperture.

3. The apparatus of claim 1 wherein said valley has a substantially uniform width.

4. The apparatus of claim 1 wherein said valley has substantially uniform dimensions.

5. The apparatus of claim 1 wherein the first lip has a first lip outer surface facing the passageway and being generally curved in longitudinal section, and the second lip has a second lip outer surface facing the passageway and being generally curved in longitudinal section.

6. The apparatus of claim 1 further comprising a condensation slot defined in the passageway.

7. The apparatus of claim 1 wherein the first lip, the second lip, and the valley are integral to a casting.

8. An apparatus comprising:

a flow passageway;

a first curved lip extending into the passageway in a substantially axial direction;

a second curved lip extending into the passageway in a substantially axial direction;

a valley intermediate the first curved lip and the second curved lip;

an exhaust inlet in flow communication with the valley; and a condensation slot defined in the passageway and interrupting the second curve lip;

wherein the valley extends intermediate the first lip and the second lip and is open to the flow passageway substantially uncovered by the first lip and the second lip.

9. The apparatus of claim 8 wherein the first curved lip, the second curved lip and the valley comprise an integrally cast flow passage constriction.

10. The apparatus of claim 8 wherein the valley defines an interior circumferential surface of the passageway having substantially constant dimensions about its circumference.

11. The apparatus of claim 8 wherein the flow passageway is coupled to an internal combustion engine.

12. The apparatus of claim 8 wherein the flow passageway includes an inlet and an outlet, the inlet is flow coupled to a source of compressed air, and the outlet is flow coupled to an engine intake manifold.

13. An apparatus comprising:

an air-exhaust mixer casting defining a passageway including an inlet and an outlet;

an interior surface of said casting extending radially inwardly in a first region to define a first constriction, radially outwardly in a second region to define a recess, and radially inwardly in a third region to define a second constriction, the recess being in flow communication with a source of exhaust; and wherein the recess is substantially open to the passageway and substantially uncovered by overhanging structure.

14. The apparatus of claim 13 wherein the source of exhaust is an EGR valve.

15. The apparatus of claim 13 wherein the interior surface defines a condensation slot in flow communication with the recess.

16. The apparatus of claim 13 wherein the inlet is in flow communication with a turbocharger output.

17. The apparatus of claim 13 wherein the recess is open to a region of the passageway intermediate the first constriction and the second constriction.

18. The apparatus of claim 13 wherein the outlet is in flow communication with an internal combustion engine air intake.

* * * * *